US005201514A

United States Patent [19]

Rebres

[11] Patent Number: 5,201,514

[45] Date of Patent: Apr. 13, 1993

[54] APPARATUS FOR DECURLING A SHEET

[75] Inventor: Robert P. Rebres, Webster, N.Y.

[73] Assignee: Xerox Corporation, Stamford, Conn.

[21] Appl. No.: 864,007

[22] Filed: Apr. 6, 1992

[51] Int. Cl.[5] ..... B65H 29/70

[52] U.S. Cl. ..... 271/188; 271/209; 271/272; 162/271

[58] Field of Search ..... 271/188, 272, 209; 162/271

[56] References Cited

U.S. PATENT DOCUMENTS

| | | | |
|---|---|---|---|
| 1,969,073 | 8/1934 | Hamre | 92/70 |
| 3,865,364 | 2/1975 | Sterner | 271/105 |
| 4,326,915 | 4/1982 | Mutschler, Jr. | 162/271 |
| 4,505,695 | 3/1985 | Billings | 493/459 |
| 4,539,072 | 9/1985 | Frye et al. | 162/197 |
| 4,561,645 | 12/1985 | Pollich | 271/195 |
| 4,627,718 | 12/1986 | Wyer | 355/35 H |
| 4,926,358 | 5/1990 | Tani et al. | 364/562 |
| 4,952,281 | 8/1990 | Akira | 162/270 |
| 4,963,943 | 10/1990 | Tamary | 355/290 |
| 4,977,432 | 12/1990 | Coombs et al. | 355/309 |
| 5,017,970 | 5/1991 | Sakata | 355/290 |
| 5,075,734 | 12/1991 | Durland et al. | 355/312 |
| 5,084,731 | 1/1992 | Baruch | 355/208 |

FOREIGN PATENT DOCUMENTS

| | | | |
|---|---|---|---|
| 60-15348 | 1/1985 | Japan | 271/188 |
| 63-242848 | 10/1988 | Japan | 271/272 |
| 2-56335 | 2/1990 | Japan | 271/272 |

*Primary Examiner*—David H. Bollinger

[57] ABSTRACT

An apparatus for decurling a sheet is disclosed. The apparatus includes a decurler shaft and a first belt positionable to contact an arcuate portion of the decurler shaft. The apparatus further includes a second belt positionable to cantact the first belt and to bend around the arcuate portion of the decurler shaft. Moreover, the apparatus includes a mechanism for advancing the sheet between the first belt and the second belt so as to bend the sheet around the arcuate portion of the decurler shaft.

13 Claims, 12 Drawing Sheets

APPARATUS FOR DECURLING A SHEET

This invention relates generally to an apparatus for improving the quality of a sheet, and more particularly concerns an apparatus for decurling a sheet.

A curl or bend may be created in a sheet as a result of its method of manufacture. In addition, a problem which sometimes occurs in a printing machine such as an electrophotographic printing machine is the development of a curl or bend in the sheet as the sheet passes through the various processing stations of the printing machine.

A curled sheet may be undesirable from a variety of standpoints. For instance, the curled sheet may be difficult to handle as the sheet is processed in a printing machine. Curled sheets may tend to produce jams or misfeeds within the printing machine. Additionally, sheets having a curl or bend therein may be esthetically undesirable to consumers thereof.

The following disclosures may be relevant to various aspects of the present invention.

U.S. Pat. No. 1,969,073 Patentee: Hamre Issued: Aug. 7, 1934

U.S. Pat. No. 3,865,364 Patentee: Sterner Issued: Feb. 11, 1975

U.S. Pat. No. 4,326,915 Patentee: Mutschler, Jr. Issued: Apr. 27, 1982

U.S. Pat. No. 4,505,695 Patentee: Billings Issued: Mar. 19, 1985

U.S. Pat. No. 4,539,072 Patentee: Frye et al. Issued: Sep. 3, 1985

U.S. Pat. No. 4,561,645 Patentee: Pollich Issued: Dec. 31, 1985

U.S. Pat. No. 4,627,718 Patentee: Wyer Issued: Dec. 9, 1986

U.S. Pat. No. 4,926,358 Patentee: Tani et al. Issued: May 15, 1990

U.S. Pat. No. 4,952,281 Patentee: Akira Issued: Aug. 28, 1990

U.S. Pat. No. 4,963,943 Patentee: Tamary Issued: Oct. 16, 1990

U.S. Pat. No. 4,977,432 Patentee: Coombs et al. Issued: Dec. 11, 1990

U.S. Pat. No. 5,017,970 Patentee: Sakata Issued: May 21, 1991

U.S. Pat. No. 5,084,731 Patentee: Baruch Issued: Jan. 28, 1992

In accordance with one aspect of the present invention, there is provided an apparatus for decurling a sheet. The apparatus includes a decurler shaft and a first belt positionable to contact an arcuate portion of the decurler shaft. The apparatus further includes a second belt positionable to contact the first belt and to bend around the arcuate portion of the decurler shaft. Moreover, the apparatus includes a mechanism for advancing the sheet between the first belt and the second belt so as to bend the sheet around the arcuate portion of the decurler shaft.

Pursuant to another aspect of the present invention, there is provided an apparatus for decurling a moving sheet. The apparatus includes a pair of belts which contact each other to define a nip through which the sheet moves. The apparatus additionally includes a decurler shaft positionable to contact one of the belts to form an arcuate region in the nip so as to bend the sheet moving therethrough.

Other features of the present invention will become apparent as the following description proceeds and upon reference to the drawings, in which.

Figure 6:
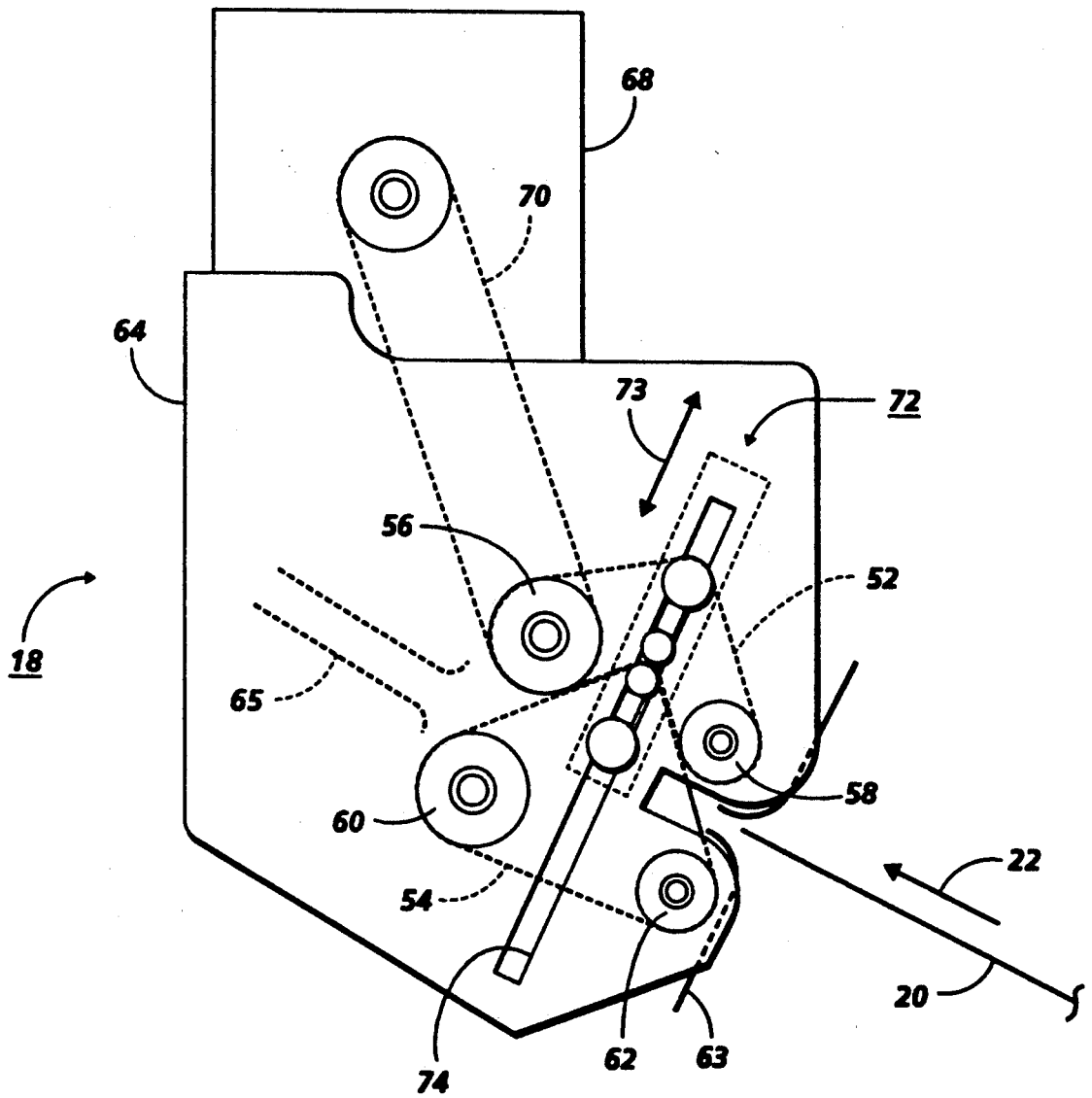
FIG. 6 is a schematic side elevational view showing further details of the belt decurling mechanism used in the sheet decurling system of FIG. 1.
Figure 7:
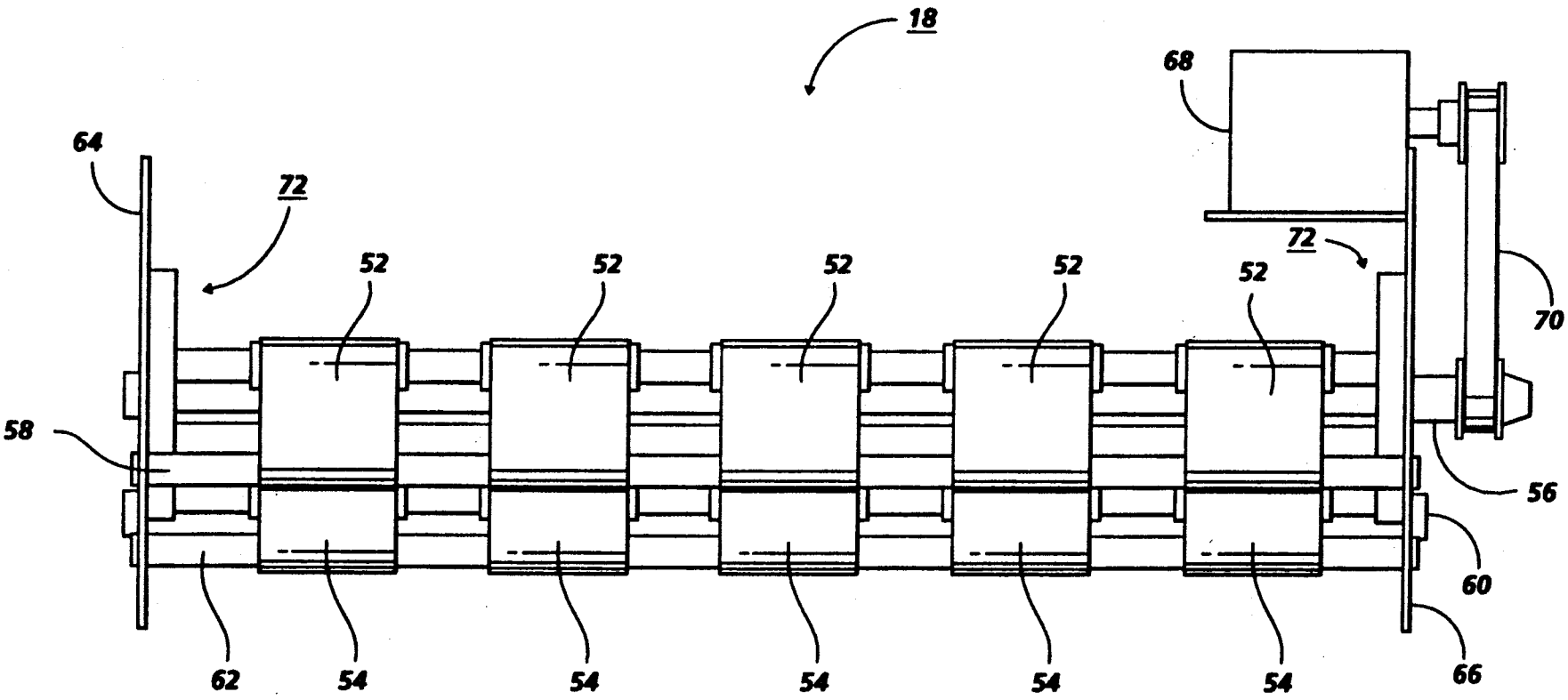
FIG. 7 is a schematic front elevational view of the belt decurling mechanism of FIG. 6 with the inlet baffle removed for clarity of description.
Figure 13:
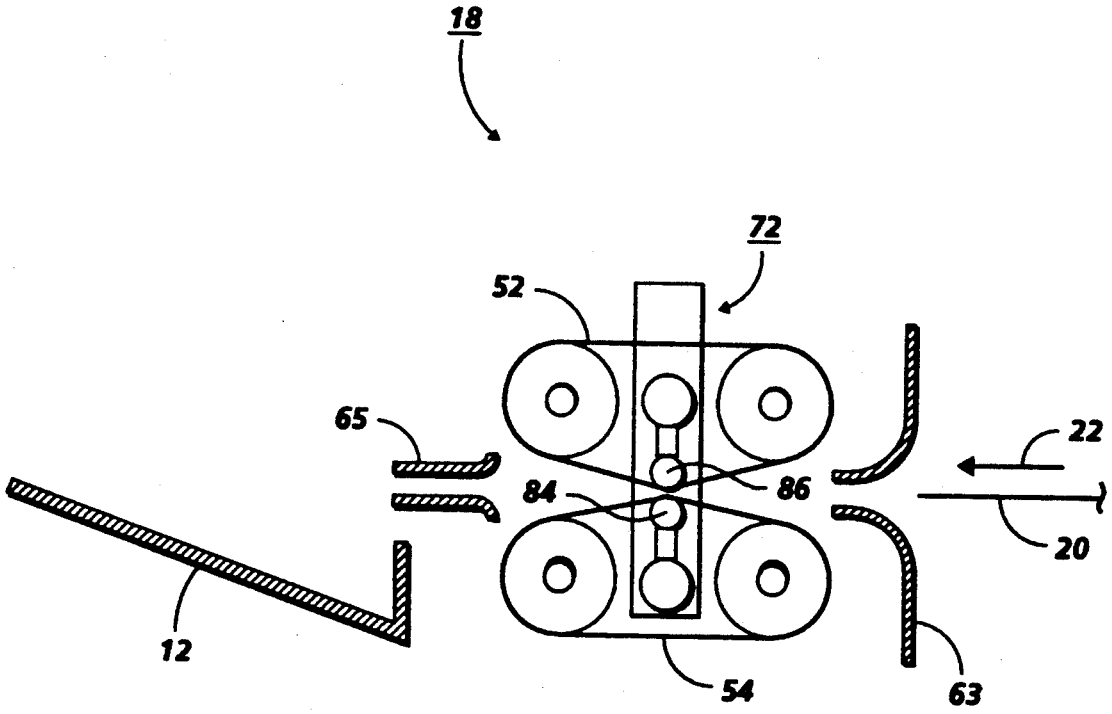
Figure 14:
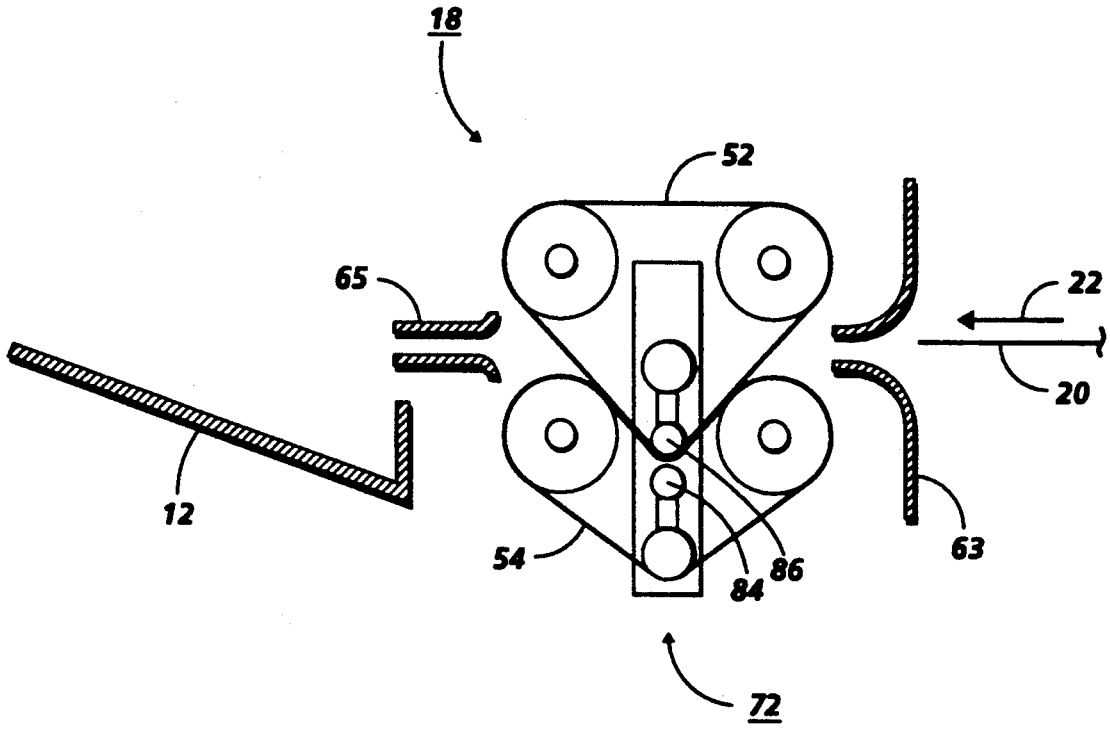

FIG. 13 is a schematic elevational view of a part of the belt decurling mechanism of FIG. 6 showing the movable assembly positioning the first set of decurling belts and the second set of decurling belts to thereby define another path through which the sheet may be advanced; and FIG. 14 is a schematic elevational view of a part of the belt decurling mechanism of FIG. 6 showing the movable assembly positioning the first set of decurling belts and the second set of decurling belts to thereby define still another path through which the sheet may be advanced.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further applications of the principles of the invention as illustrated therein being contemplated as would normally occur to one skilled in the art to which the invention relates.

Figure 1:
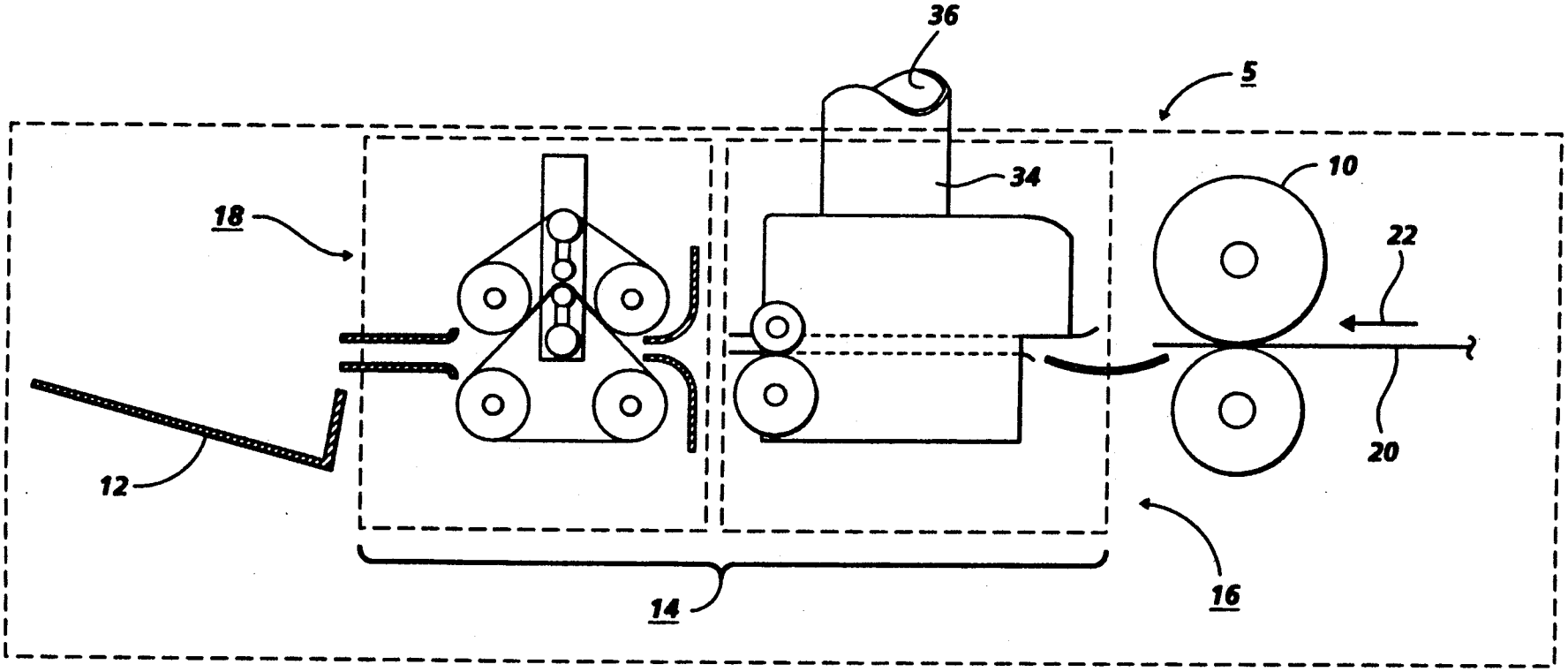
FIG. 1 is a schematic elevational view showing a sheet decurling system of a printing machine incorporating the features of the present invention therein.
Figure 2:
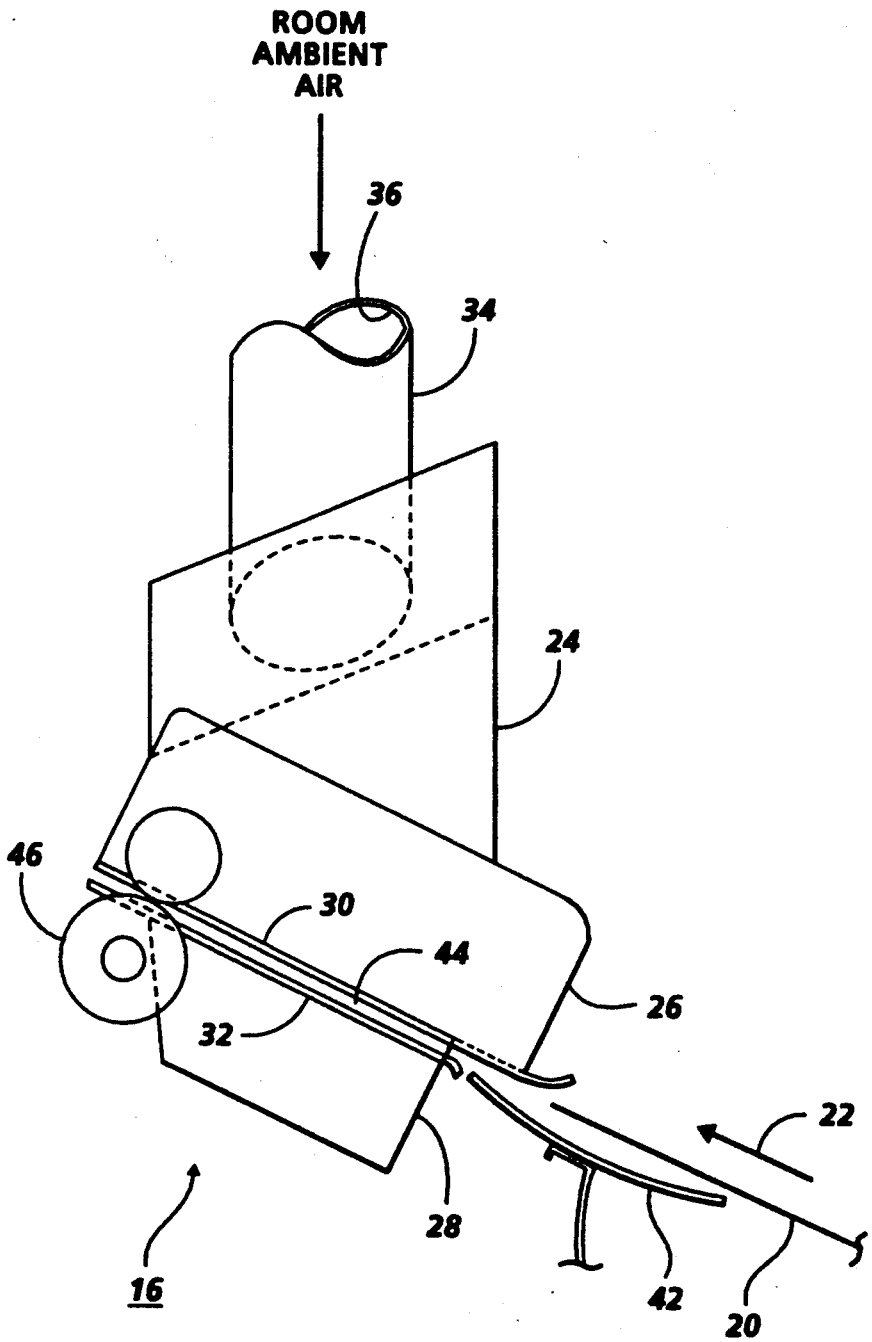
FIG. 2 is a schematic side elevational view showing further details of the equilibrium station used in the sheet decurling system of FIG. 1.
Figure 3:
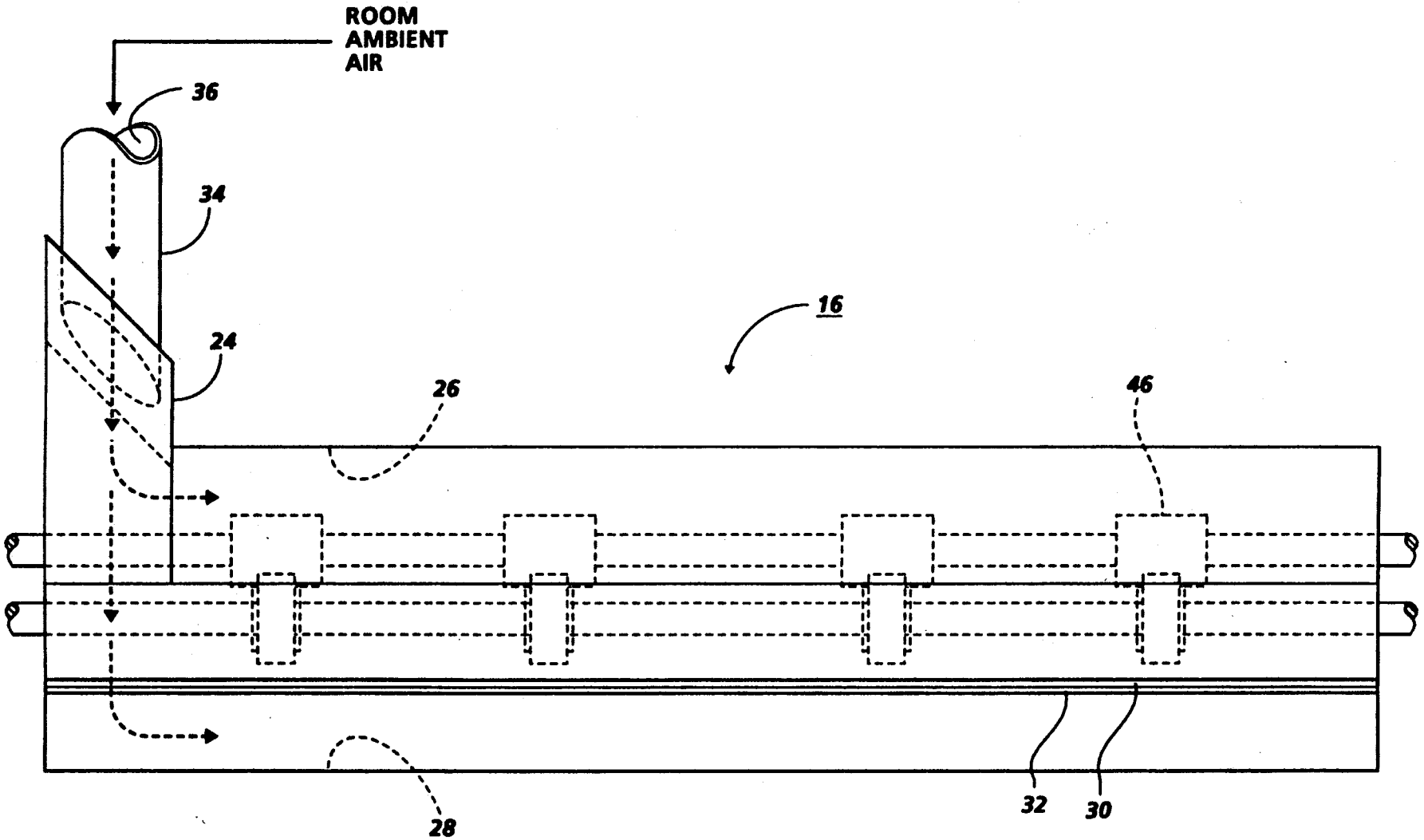
FIG. 3 is a schematic front elevational view of the equilibrium station of FIG. 2.
Figure 4:
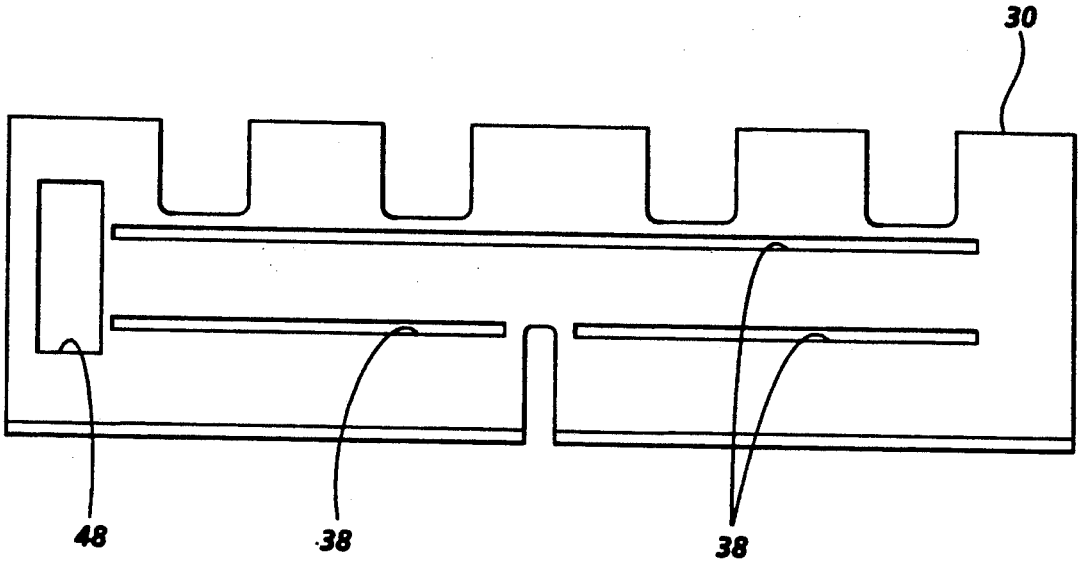
FIG. 4 is a schematic planar view showing the plate of the upper plenum duct of the equilibrium station of FIG. 2.
Figure 5:
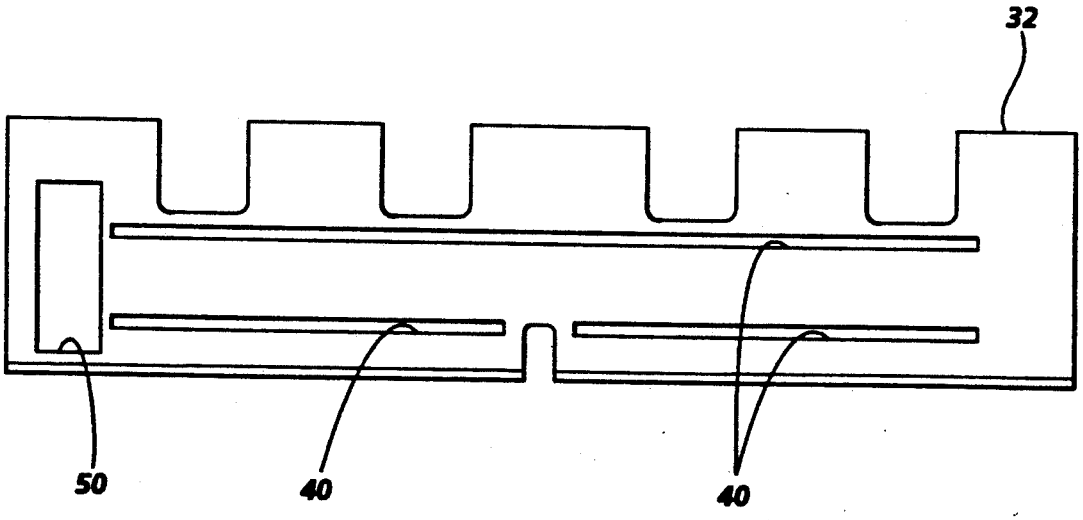
FIG. 5 is a schematic planar view showing the plate of the lower plenum duct of the equilibrium station of FIG. 2.

In FIG. 1 of the drawings, there is shown a printing machine, generally indicated by the reference numeral 5. The printing machine may be an electrophotographic printing machine such as the printing machine described in U.S. Pat. No. 5,075,734 issued to Durland et al., the disclosure of which is hereby incorporated by reference. The printing machine 5 includes a fuser apparatus 10, a catch tray 12 and a sheet decurling system, indicated generally by the reference numeral 14. The sheet decurling system 14 includes an equilibrium station, indicated generally by the reference numeral 16, and a belt decurling mechanism, indicated generally by the reference numeral 18. The decurling system 14 receives a sheet 20, traveling in the direction of arrow 22, from the output of the fuser apparatus 10. The decurling system 14 then physically acts on the sheet to reduce the amount of curl therein and subsequently guides the sheet to the catch tray 12 for subsequent removal therefrom by a machine operator.

The equilibrium station 16 is shown in more detail in FIGS. 2-5. In particular, the equilibrium station 16 includes a fan 34 for producing a current or flow of air. The fan 34 is schematically illustrated by a tube in FIGS. 1-3. The fan 34 has an intake port 36 positioned to receive ambient air directly from a location outside of the printing machine 5 (also see FIGS. 1-3). To achieve the above, the intake port may be positioned adjacent an outer wall of the printing machine 5 or the port may extend beyond an outer wall of the printing machine. Ambient air located outside of the walls of a printing machine has significantly different characteristics, such as temperature and relative humidity levels, in comparison to ambient air located inside of the walls of a printing machine. Ambient air received directly from a location outside of the walls of the printing machine 5 will hereinafter be referred to as "room ambient air" while ambient air received from a location inside of the walls of the printing machine 5 will be hereinafter referred to as "machine ambient air." The equilibrium station 16 further includes a connection duct 24, an upper plenum duct 26 and a lower plenum duct 28. The upper plenum duct 26 includes a plate 30 while the lower plenum duct 28 includes a plate 32. Defined in plate 30 is a number of elongated apertures 38 and an air passageway 48 (see FIG. 4). Similarly, plate 32 has a number of elongated apertures 40 and an air passageway 50 defined therein (see FIG. 5). The upper plenum duct 26 receives a flow of room ambient air via the fan 34 and the connection duct 24. The lower plenum duct 28 receives a flow of room ambient air via the fan 34, the connection duct 24 and passageways 48 and 50. The flow of room ambient air received within upper plenum duct 26 exits through apertures 38 defined in plate 30. Similarly, the flow of room ambient air received within lower plenum duct 28 exits through apertures 40 defined in plate 32. As the sheet 20 is advanced in the direction of arrow 22, the sheet is guided by a guide member 42 into a space 44 defined between plate 30 and plate 32 (see FIG. 2). As the sheet 20 passes through the equilibrium station 16 within the space 44, a flow of room ambient air is directed against both sides of the sheet via the elongated apertures 38 and 40. The equilibrium station 16 further includes a pair of rollers 46 which assists in the advancement of the sheet 20 through the equilibrium station.

The belt decurling mechanism 18 is shown in more detail in FIGS. 6-14. More specifically, the belt decurling mechanism 18 includes a first set of decurler belts 52 and a second set of decurler belts 54. The first set of decurler belts 52 are entrained about a first belt shaft 56 and a second belt shaft 58. The second set of decurler belts 54 are entrained about a third belt shaft 60 and a fourth belt shaft 62. Belt shafts 56, 58, 60 and 62 are each mounted between a pair of side plates 64 and 66. A motor 68 is secured adjacent to the sideplate 66 (see FIG. 7) and mechanically coupled to the first belt shaft 56 by a drive belt 70. In turn, the first belt shaft 56 is mechanically coupled to the third belt shaft 60 by a set of gears (not shown). As the motor 68 rotates the drive belt 70, the first belt shaft 56 and consequently the third belt shaft 60 are caused to rotate. As a result, each of the decurler belts 52 and each of the decurler belts 54 are caused to advance in a recirculating path of movement. The belt decurling mechanism 18 further includes an inlet baffle 63 and an outlet baffle 65.

Figure 8:
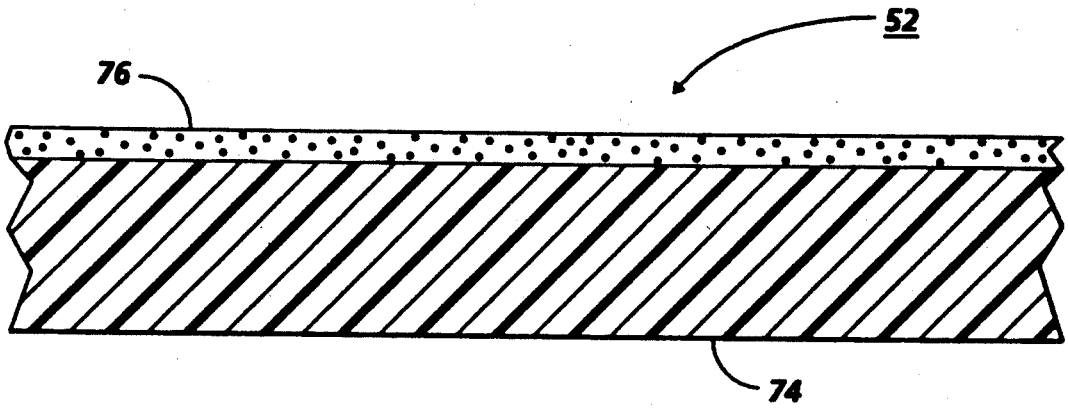
FIG. 8 is a fragmentary sectional view of one belt of the first set of decurling belts of the belt decurling mechanism of FIG. 6.
Figure 9:
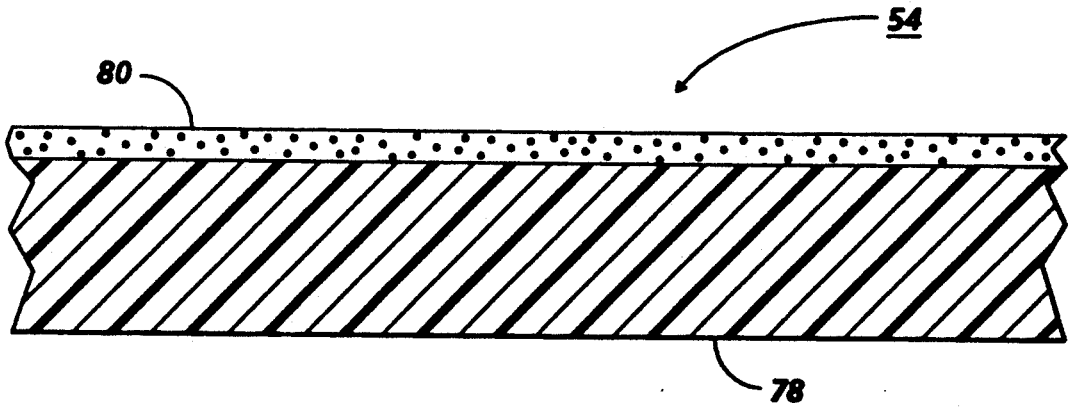
FIG. 9 is a fragmentary sectional view of one belt of the second set of decurling belts of the belt decurling mechanism of FIG. 6.
Figure 10:
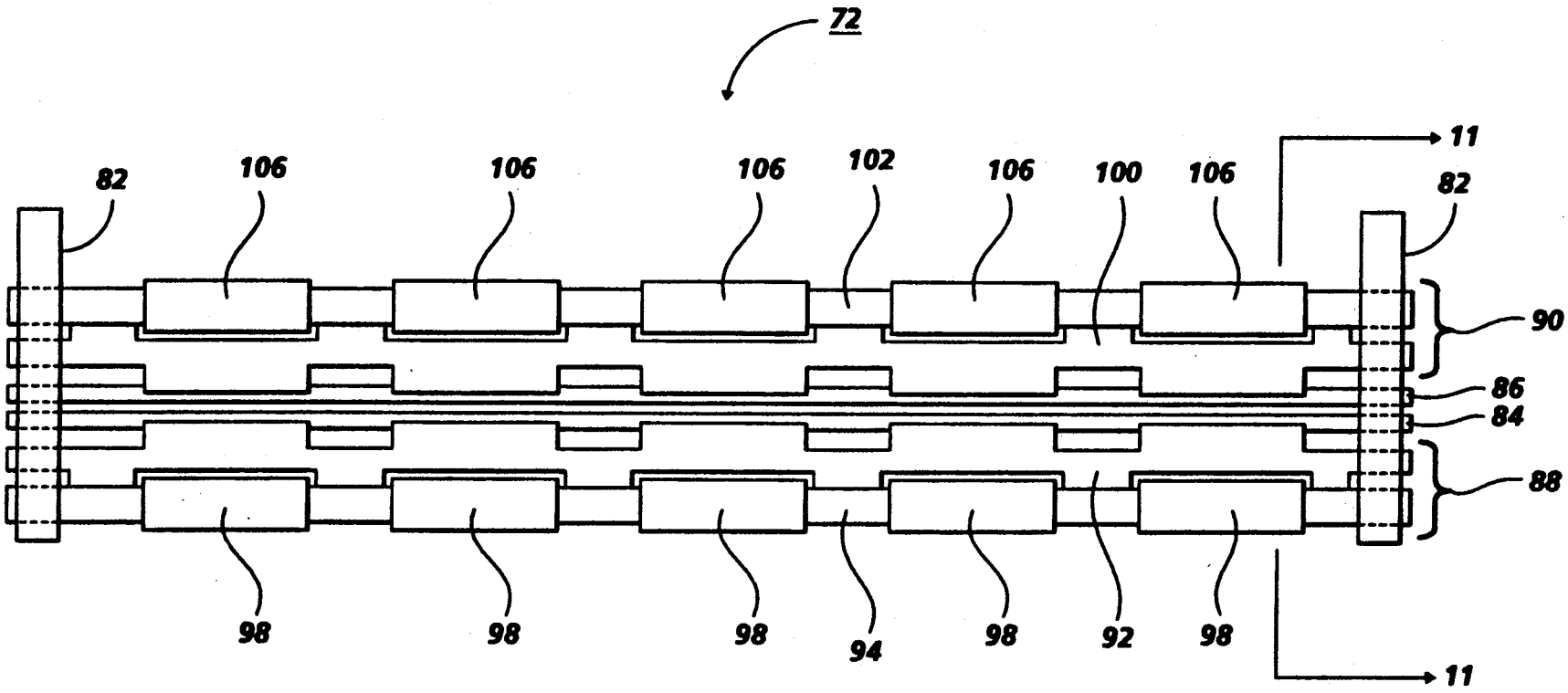
FIG. 10 is a front elevational view of the movable assembly of the belt decurling mechanism of FIG. 6.
Figure 11:
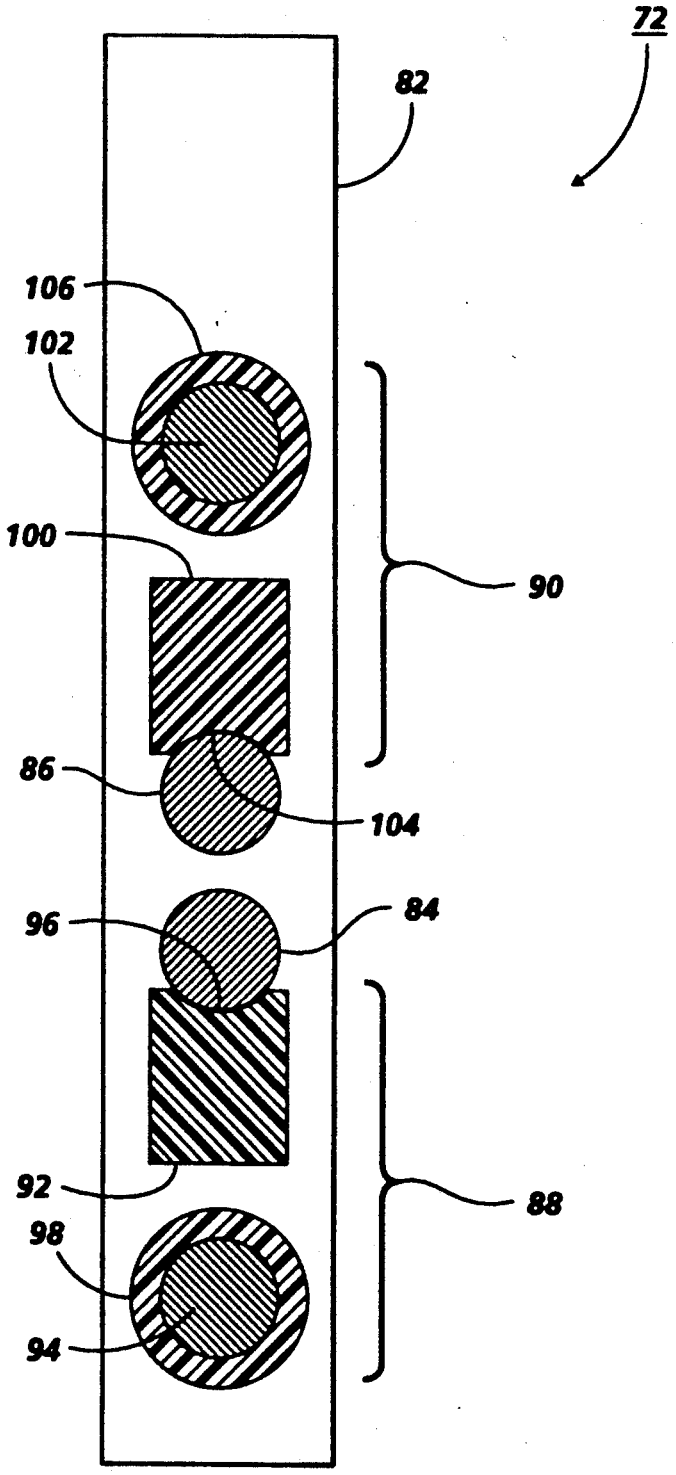
FIG. 11 is a sectional elevational view taken in the direction of arrows 11—11 of FIG. 10 of the movable assembly of FIG. 6.

The decurler belts 52 and 54 are shown in more detail in FIGS. 8 and 9. In particular, the decurler belts 52 are each made from a polyurethane material. As a result, an inner surface portion 74 of each of the decurler belts 52 comprises a polyurethane material. However, molded in an outer surface portion 76 of each of the decurler belts 52 is a dispersion of fine powder material. Preferably, the fine powder material is an ultra high molecular weight polyethylene material. Since the outer surface portion 76 of each of the decurler belts 52 comprises a fine powder material such as an ultra high molecular weight polyethylene material, the frictional resistance between the outer surface portion 76 of each of the decurler belts 52 and the sheet 20 is reduced during advancement of the sheet through the belt decurling mechanism 18. Similarly, the decurler belts 54 are each made from a polyurethane material. As a result, an inner surface portion 78 of each of the decurler belts 54 comprises a polyurethane material. However, molded in an outer surface portion 80 of each of the decurler belts 54 is a dispersion of fine powder material. Preferably, the fine powder material comprises an ultra high molecular weight polyethylene material. Since the outer surface portion 80 of each of the decurler belts 54 comprises a fine powder material such as an ultra high molecular weight polyethylene material, the frictional resistance between the outer surface portion 80 of each of the decurler belts 54 and the sheet 20 is reduced during advancement of the sheet through the belt decurling mechanism 18. During advancement of the sheet through the belt decurling mechanism 18, the sheet is advanced between the outer surface portion 76 of each of the decurler belts 52 and the outer surface portion 80 of each of the decurler belts 54.

The belt decurling mechanism 18 additionally includes a movable assembly, generally indicated by the reference numeral 72. The movable assembly 72 is slidably mounted between sideplates 64 and 66. An elongated slot 74 is defined in sideplate 64 while a similar elongated slot (not shown) is defined in sideplate 66. The movable assembly 72 is selectively positionable at one of a number of positions along the length of the elongated slots as indicated by the two headed arrow 73 in FIG. 6 The printing machine 5 may be equipped with a mechanism (not shown) which allows the machine operator to manually adjust the movable assembly 72 to a desired position or the printing machine may incorporate a mechanism (not shown), including a control system, which automatically adjusts the movable assembly to a desirable position in response to various sensed characteristics of the sheet such as the magnitude of curl in the sheet, the amount of toner on the sheet, and the size and orientation of the sheet. The movable assembly 72 is shown in more detail in FIGS. 10 and 11. The movable assembly includes a pair of end blocks 82. Mounted between the end blocks 82 is a first decurler shaft 84 and a second decurler shaft 86. Also mounted between the end blocks 82 and positioned in contact with the first decurler shaft 84 is a first support assembly 88. A second support assembly 90 is mounted between the end blocks 82 and positioned in contact with the second decurler shaft 86. The first support assembly 88 includes a support beam 92 and a support shaft 94. The support beam 92 is made of an acetal resin material. By way of example, the support beam 92 can be made from DelrinAF, a trademark of E.I. du Pont de Nemours & Co., Inc. of Wilmington, Del. The support beam 92 defines a bearing surface 96 which is positioned to contact the first decurler shaft 84. The first support beam 92 is also positioned to contact the support shaft 94 (see FIG. 10). The first support assembly 88 also includes a number of cylindrical bearings 98, each being positioned around a portion of the support shaft 94 (see FIGS. 7 and 10). The cylindrical bearings 98 are caused to rotate around support shaft 94 when the decurler belts 54 are being advanced and are respectively positioned in contact with the cylindrical bearings 98. The second support assembly 90 includes a support beam 100 and a support shaft 102. The support beam 100 is made of an acetal resin material. By way of example, the support beam 100 can be made from DelrinAF, a trademark of E.I. du Pont de Nemours & Co., Inc. of Wilmington, Del. The support beam 100 defines a bearing surface 104 which is positioned to contact the second decurler shaft 86. The support beam 100 is also positioned to contact the support shaft 102 (see FIG. 10). The second support assembly 90 also includes a number of cylindrical bearings 106, each being positioned around a portion of the support shaft 102 (see FIGS. 7 and 10). The cylindrical bearings 106 are caused to rotate around support shaft 102 when the decurler belts 52 are being advanced and are respectively positioned in contact with the cylindrical bearings 106.

Figure 12:
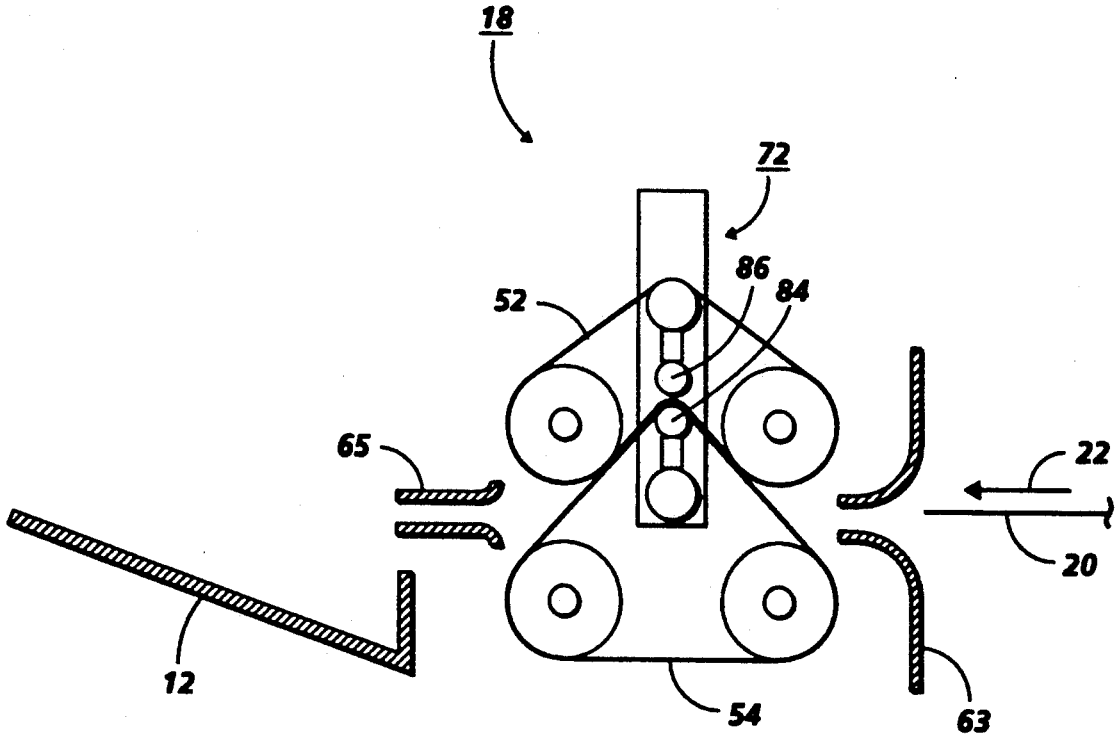
FIG. 12 is a schematic elevational view of a part of the belt decurling mechanism of FIG. 6 showing the movable assembly positioning the first set of decurling belts and the second set of decurling belts to thereby define a path through which the sheet may be advanced.

An arcuate portion or region of the first decurler shaft 84 is positionable to contact the inner surface portion 78 of each of the decurler belts 54 while an arcuate portion or region of the second decurler shaft 86 is positionable to contact the inner surface portion 74 of each of the decurler belts 52. In operation, the decurler belts 52 and the decurler belts 54 each travel through the space defined between the first decurler shaft 84 and the second decurler shaft 86 (see FIGS. 1, 6 and 10–14). Therefore, as the movable assembly 72 is linearly adjusted to one of a variety of positions, as shown in FIGS. 12–14, the sheet path through the belt decurling mechanism 18 is correspondingly adjusted. As a result, a discrete amount of mechanical force may be applied to the sheet within a range of amounts of mechanical force in either the positive or the negative direction as the sheet is advanced through the nip defined by the area of contact between the outer surface portion 76 of each of the decurler belts 52 and the outer surface portion 80 of each of the of decurler belts 54. When the movable assembly 72 is positioned as shown in FIG. 12, each of the decurler belts 54 are positioned in contact with an arcuate portion of the first decurler shaft 84 while each of the decurler belts 52 are respectively positioned in contact with the decurler belts 54 and are bent around the arcuate portion of the first decurler shaft 84. When the movable assembly 72 is positioned at a neutral decurling position as shown in FIG. 13, the decurler belts 52 are spaced apart from the decurler belts 54. At this neutral decurling position, only a nominal amount of mechanical force is exerted against the sheet by the belt decurling mechanism 18. When the movable assembly 72 is positioned as shown in FIG. 14, each of the decurler belts 52 are positioned in contact with an arcuate portion of the second decurler shaft 86 while each of the decurler belts 54 are respectively positioned in contact with the decurler belts 52 and are bent around the arcuate portion of the second decurler shaft 86.

To aid in the guidance of the sheet through the sheet path of the belt decurling mechanism 18, a strip of flexible material (not shown) may be positioned near the sheet path between each set of neighboring decurler belts 52, and also between each set of neighboring decurler belts 54. Each strip of flexible material would extend from the inlet baffle 63 to the outlet baffle 65 and through the space defined between the first decurler shaft 84 and the second decurler shaft 86.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim:

1. An apparatus for decurling a sheet, comprising:

a decurler shaft;

a first belt positionable to contact an arcuate portion of said decurler shaft;

a second belt positionable to contact said first belt and to bend around the arcuate portion of said decurler shaft;

means for advancing the sheet between said first belt and said second belt so as to bend the sheet around the arcuate portion of said decurler shaft; and means for supporting said decurler shaft, said supporting means contacting said decurler shaft at a location between the end portions of said decurler shaft.

2. The apparatus of claim 1, further comprising a second decurler shaft, an arcuate portion of said second decurler shaft being positionable to contact said second belt.

3. The apparatus of claim 2, further comprising:

a first support assembly positioned in contact with said first decurler shaft; and a second support assembly positioned in contact with said second decurler shaft.

4. The apparatus of claim 1, wherein said supporting means comprises a support beam defining a bearing surface which contacts said decurler shaft at a location between the end portions of said decurler shaft.

5. The apparatus of claim 4, wherein said supporting means further comprises:

a support shaft positioned in contact with said support beam; and a cylindrical bearing positioned around a portion of said support shaft.

6. An apparatus for decurling a sheet, comprising:

a decurler shaft;

a first belt positionable to contact an arcuate portion of said decurler shaft;

a second belt positionable to contact said first belt and to bend around the arcuate portion of said decurler shaft;

means for advancing the sheet between said first belt and said second belt so as to bend the sheet around the arcuate portion of said decurler shaft; and a support assembly positioned in contact with said decurler shaft, said support assembly comprising
a support beam defining a bearing surface adapted to contact said decurler shaft,
a support shaft positioned in contact with said support beam, and
a cylindrical bearing positioned around a portion of said support shaft.

7. An apparatus for decurling a sheet, comprising:
a decurler shaft;
a first belt positionable to contact an arcuate portion of said decurler shaft;
a second belt positionable to contact said first belt and to bend around the arcuate portion of said decurler shaft;
means for advancing the sheet between said first belt and said second belt so as to bend the sheet around the arcuate portion of said decurler shaft;
a second decurler shaft, an arcuate portion of said second decurler shaft being positionable to contact said second belt;
a first support assembly positioned in contact with said first decurler shaft; and
a second support assembly positioned in contact with said second decurler shaft,
wherein said first support assembly comprises a first support beam, said first support beam defining a first bearing surface adapted to contact said first decurler shaft, and further wherein said second support assembly comprises a second support beam, said second support beam defining a second bearing surface adapted to contact said second decurler shaft.

8. The apparatus of claim 7, wherein said first support assembly further comprises a first support shaft positioned in contact with said first support beam, and a first cylindrical bearing positioned around a portion of said first support shaft, and further wherein said second support assembly further comprises a second support shaft positioned in contact with said second support beam, and a second cylindrical bearing positioned around a portion of said second support shaft.

9. An apparatus for decurling a sheet, comprising:
a decurler shaft;
a first belt positionable to contact an arcuate portion of said decurler shaft;
a second belt positionable to contact said first belt and to bend around the arcuate portion of said decurler shaft;
means for advancing the sheet between said first belt and said second belt so as to bend the sheet around the arcuate portion of said decurler shaft;
a third belt positionable to contact the arcuate portion of said decurler shaft; and
a fourth belt positionable to contact said third belt and to bend around the arcuate portion of said decurler shaft.

10. An apparatus for decurling a moving sheet, comprising:
a pair of belts which contact each other to define a nip through which the sheet moves;
a decurler shaft positionable to contact one of the belts to form an arcuate region in the nip so as to bend the sheet moving therethrough; and
means for supporting said decurler shaft, said supporting means contacting said decurler shaft at a location between the end portions of said decurler shaft.

11. The apparatus of claim 10, wherein said supporting means comprises a support beam defining a bearing surface which contacts said decurler shaft at a location between the end portions of said decurler shaft.

12. The apparatus of claim 11, wherein said supporting means further comprises:
a support shaft positioned in contact with said support beam; and
a cylindrical bearing positioned around a portion of said support shaft.

13. An apparatus for decurling a moving sheet, comprising:
a pair of belts which contact each other to define a nip through which the sheet moves;
a decurler shaft positionable to contact one of the belts to form an arcuate region in the nip so as to bend the sheet moving therethrough; and
a support assembly positioned in contact with said decurler shaft, said support assembly comprising
a support beam defining a bearing surface adapted to contact said decurler shaft,
a support shaft positioned in contact with said support beam, and
a cylindrical bearing positioned around a portion of said support shaft.

* * * * *